US011095965B2

(12) United States Patent
Julstrom et al.

(10) Patent No.: US 11,095,965 B2
(45) Date of Patent: Aug. 17, 2021

(54) SYSTEM AND METHOD FOR REDUCING WIND NOISE IN AN ELECTRONIC HEARING PROTECTOR

(71) Applicant: Etymotic Research, Inc., Elk Grove Village, IL (US)

(72) Inventors: Stephen D. Julstrom, Chicago, IL (US); Tim Monroe, Schaumburg, IL (US); Charles Aldous, Bensenville, IL (US)

(73) Assignee: ETYMOTIC RESEARCH, INC., Elk Grove Village, IL (US)

( * ) Notice: Subject to any disclaimer, the term of this patent is extended or adjusted under 35 U.S.C. 154(b) by 0 days.

(21) Appl. No.: 16/994,047

(22) Filed: Aug. 14, 2020

(65) Prior Publication Data

US 2020/0374612 A1 Nov. 26, 2020

Related U.S. Application Data

(62) Division of application No. 16/206,136, filed on Nov. 30, 2018, now Pat. No. 10,779,069.
(Continued)

(51) Int. Cl.
*H04R 25/00* (2006.01)
*H04R 1/08* (2006.01)
(Continued)

(52) U.S. Cl.
CPC ..... *H04R 1/086* (2013.01); *H04R 1/04* (2013.01); *H04R 1/1083* (2013.01);
(Continued)

(58) Field of Classification Search
CPC . H04R 25/00; H04R 2225/49; H04R 2460/01
(Continued)

(56) References Cited

U.S. PATENT DOCUMENTS 6,236,731 B1 * 5/2001 Brennan ..... H03H 17/0266 381/312
6,427,018 B1 7/2002 Keliiliki
(Continued)

OTHER PUBLICATIONS

PCT International Search Report for International Application No. PCT/US2018/064073, filed Dec. 5, 2018, dated Apr. 1, 2019, 8 pages.
(Continued)

*Primary Examiner* — Suhan Ni
(74) *Attorney, Agent, or Firm* — McAndrews, Held & Malloy, Ltd.

(57) ABSTRACT

Systems and methods for reducing wind noise in an electronic hearing protector are provided. The electronic hearing protector includes a housing and a windscreen. The housing includes a cut-out portion having at least one acoustic inlet. The windscreen covers the cut-out portion and includes an outer surface. An acoustic path within the cut-out portion from an effective center of the acoustic inlet(s) to the windscreen is at least 100 degrees. A minimum distance from the effective center of the acoustic inlet(s) to the outer surface of the windscreen is at least 2.5 millimeters. In various embodiments, the electronic hearing protector may include a high-level limiter disposed in the housing. The high-level limiter selectively attenuates a frequency below a voice range more than a frequency in the voice range of a microphone input signal to provide a signal output with noise reduction at frequencies outside of the voice range.

10 Claims, 8 Drawing Sheets

Related U.S. Application Data

(60) Provisional application No. 62/596,462, filed on Dec. 8, 2017.

(51) Int. Cl.
*H04R 1/04* (2006.01)
*H04R 1/10* (2006.01)

(52) U.S. Cl.
CPC ..... *H04R 25/652* (2013.01); *H04R 1/1016* (2013.01); *H04R 2410/07* (2013.01)

(58) Field of Classification Search
USPC ..... 381/312, 316–318, 320
See application file for complete search history.

(56) References Cited

U.S. PATENT DOCUMENTS 6,480,610 B1 * 11/2002 Fang ..... H04R 25/453 381/318
6,738,486 B2 * 5/2004 Kaulberg ..... H04R 25/453 381/318
7,580,541 B2 8/2009 Hlas
2004/0234094 A1 11/2004 Saunders et al.
2005/0157897 A1 7/2005 Saltykov
2007/0003085 A1 1/2007 Meier et al.
2007/0086599 A1 4/2007 Wilmink
2014/0247956 A1 * 9/2014 Andersen ..... H04R 25/50 381/316
2014/0254852 A1 9/2014 Haapapuro et al.

OTHER PUBLICATIONS

PCT International Search Report for International Application No. PCT/US2018/064073, filed Dec. 5, 2018, dated Jun. 18, 2020, 6 pages.

* cited by examiner

300

SYSTEM AND METHOD FOR REDUCING WIND NOISE IN AN ELECTRONIC HEARING PROTECTOR

CROSS-REFERENCE TO RELATED APPLICATIONS/INCORPORATION BY REFERENCE

The present application is a divisional and claims priority under 35 U.S.C. § 121 to co-pending U.S. patent application Ser. No. 16/206,136, filed Nov. 30, 2018, entitled "SYSTEM AND METHOD FOR REDUCING WIND NOISE IN AN ELECTRONIC HEARING PROTECTOR," which claims priority under 35 U.S.C. § 119(e) to provisional application Ser. No. 62/596,462 filed on Dec. 8, 2017, entitled "SYSTEM AND METHOD FOR REDUCING WIND NOISE IN AN ELECTRONIC HEARING PROTECTOR." Each of the above referenced prior-filed applications is hereby expressly incorporated herein by reference in its entirety.

FIELD

The present disclosure relates to an apparatus that receives ambient sound at a microphone disposed in an earplug. More specifically, the present disclosure relates to an in-the-ear electronic hearing protector having high-level limiter circuitry and/or an integrated windscreen operable to reduce wind noise.

BACKGROUND

Existing electronic earplugs or other in-the-ear devices can include a microphone for receiving ambient sound to provide to an ear canal. For example, a microphone disposed within a housing of the earplug may receive ambient sound via a microphone inlet in the housing. In windy environments, the microphone of an electronic earplug can pick up noise created by the moving air. As an example, a user of an electronic earplug can have difficulty understanding ambient sounds received at a microphone when outside on a gusty day, in an open moving vehicle, or in a breezy room, among other things. Such wind noise may discourage potential users from wearing the electronic earplug.

Conventional electronic earplugs provide a microphone inlet positioned adjacent to or the same as the housing inlet. The microphone and/or housing inlet may include a thin film meant primarily to protect the microphone from debris; however, these films are ineffective at reducing wind noise. Existing effective windscreens, such as the Electronic Earplug Windscreen disclosed in U.S. Pat. No. 9,232,292 issued to Haapapuro et al. on Jan. 5, 2016, which is incorporated by reference herein in its entirety, are attached to the outside of the probe housing, which may provide an undesirable appearance and can interfere with other devices such as tactical headsets that may be worn over the electronic earplugs.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide systems and methods for reducing wind noise in an electronic hearing protector, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
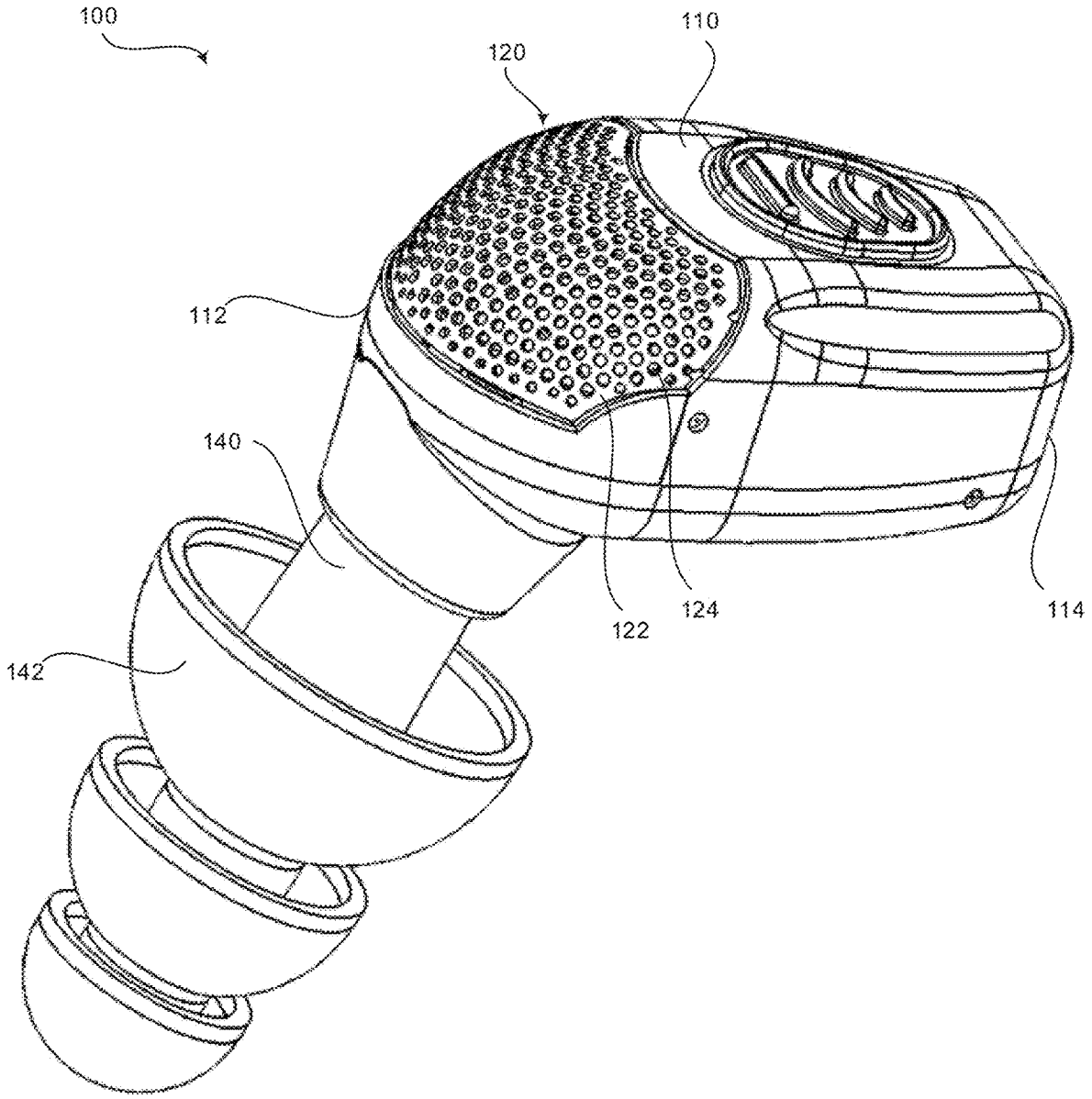
FIG. 1 is a perspective view of an exemplary in-the-ear device comprising an integrated windscreen, in accordance with various embodiments.

Embodiments of the present technology provide an in-the-ear electronic hearing protector (also referred to as an in-the-ear electronic earplug) having high-level limiter circuitry and/or an integrated windscreen operable to reduce wind noise. In various embodiments, the windscreen is integrated at a cut out portion of the housing and positioned at a distance from the one or more acoustic inlets to provide increased wind noise reduction effectiveness. In certain embodiments, the windscreen and microphone are positioned at or near the insertion end of the electronic hearing protector adjacent the sound tube to align the windscreen and microphone substantially behind the tragus of a user such that the tragus partially shields at least a portion of the windscreen and acoustic inlet from the wind. In an exemplary embodiment, the high-level limiter circuitry reduces high-level sustained sounds such as wind noise, reverberation from gunshots inside an indoor shooting range, and the like. Aspects of the present disclosure aid users in understanding ambient sounds received at one or more microphones of an in-the-ear device in windy environments.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments. The following detailed description is, therefore, not to be taken in a limiting sense, and the scope of the present disclosure is defined by the appended claims and their equivalents.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Furthermore, the term processing circuitry, as used herein, refers to any type of processing unit that can carry out the required calculations needed for the disclosure, such as single or multi-core: CPU, DSP, FPGA, ASIC or a combination thereof.

In-the-Ear Device with Integrated Windscreen

Figure 2:
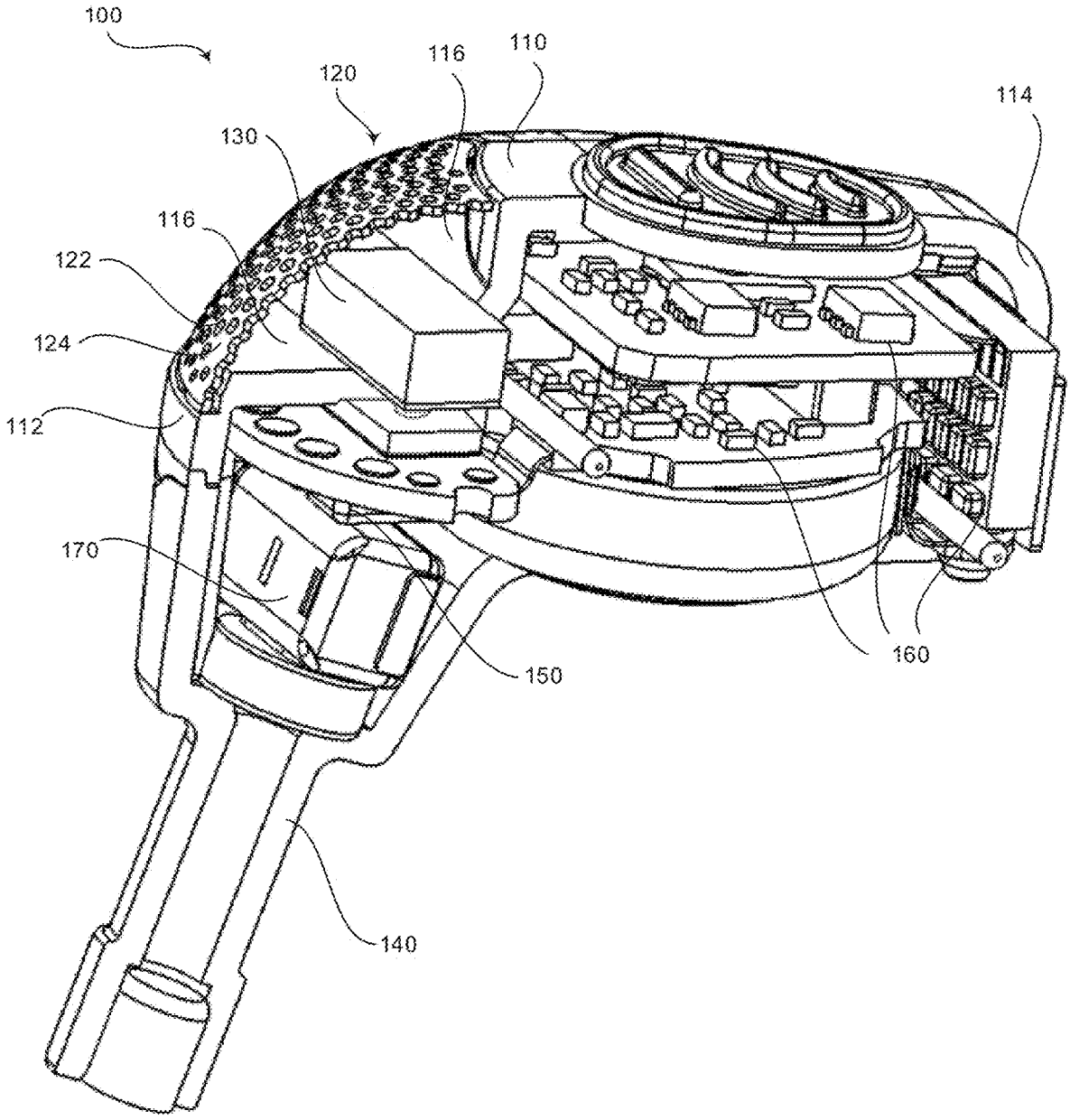
FIG. 2 is a perspective, partial cross-sectional view of an exemplary in-the-ear device comprising an integrated windscreen, in accordance with exemplary embodiments.
Figure 3:
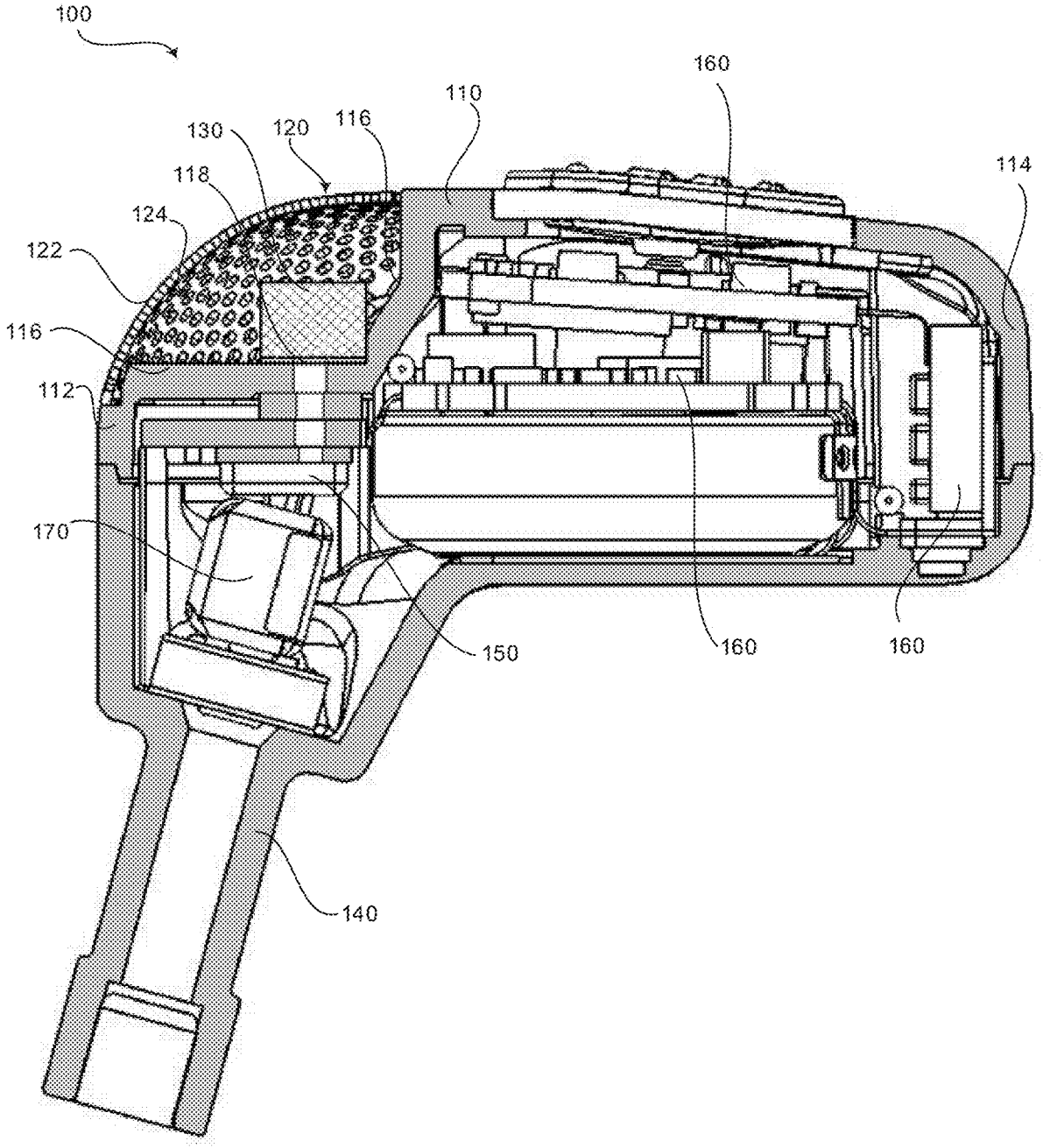
FIG. 3 is a side, partial cross-sectional view of an exemplary in-the-ear device comprising an integrated windscreen, in accordance with various embodiments.
Figure 4:
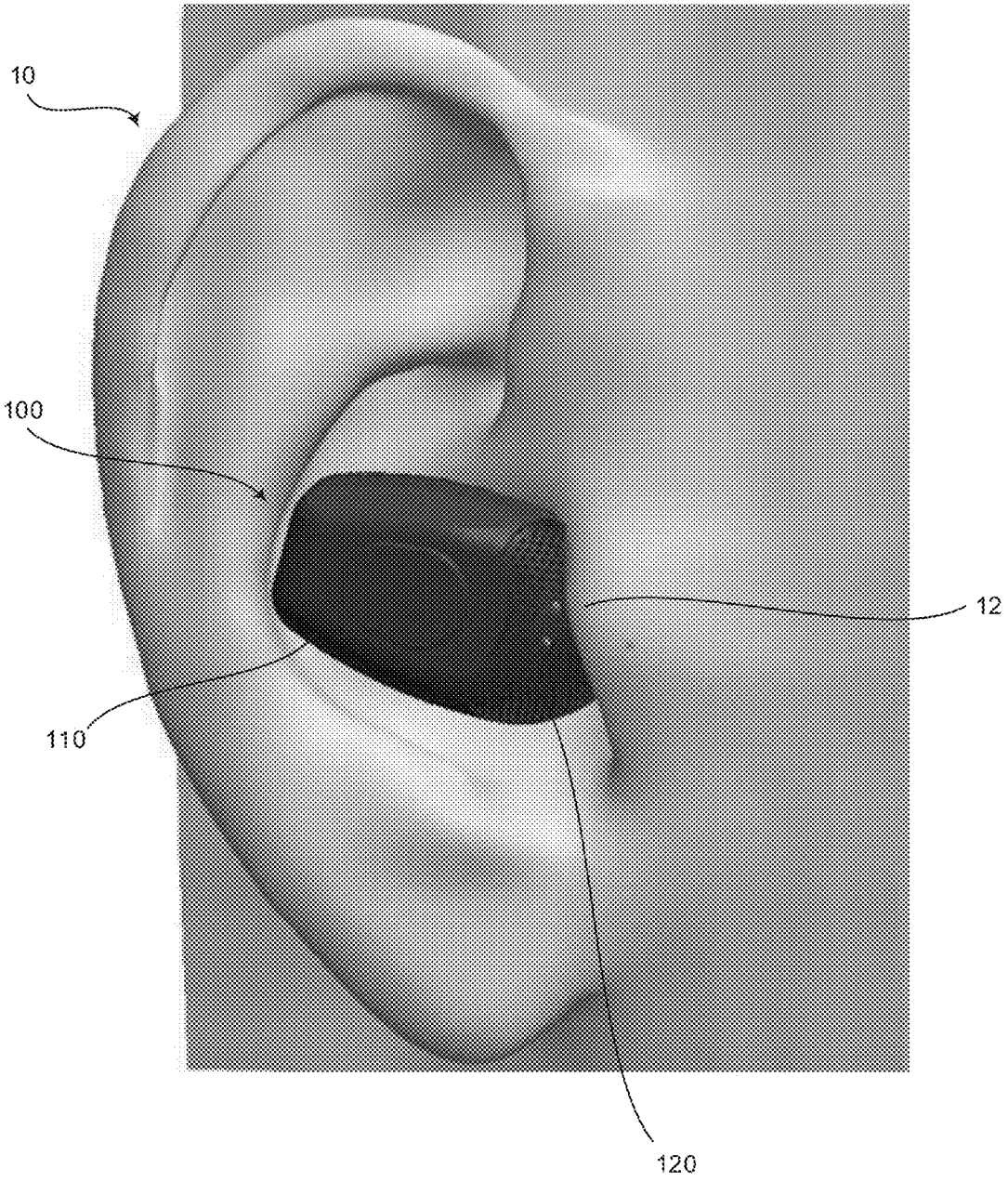
FIG. 4 is a perspective view of an exemplary in-the-ear device comprising an integrated windscreen positioned in an ear of a user, in accordance with exemplary embodiments.

FIG. 1 is a perspective view of an exemplary in-the-ear device 100 comprising an integrated windscreen 120, in accordance with various embodiments. FIG. 2 is a perspective, partial cross-sectional view of an exemplary in-the-ear device 100 comprising an integrated windscreen 120, in accordance with exemplary embodiments. FIG. 3 is a side, partial cross-sectional view of an exemplary in-the-ear device 100 comprising an integrated windscreen 120, in accordance with various embodiments. FIG. 4 is a perspective view of an exemplary in-the-ear device 100 comprising an integrated windscreen 120 positioned in an ear of a user, in accordance with exemplary embodiments.

Referring to FIGS. 1-4, the in-the-ear electronic earplug 100 comprises a housing 110, windscreen 120, acoustic inlet covering 130, sound tube 140, microphone(s) 150, processing circuitry 160, and receiver 170. The housing 110 may be configured to house the microphone(s) 150 and any suitable electronic earplug components, such as processing circuitry 160, the receiver 170, and the like. The housing may have a first end 112 and a second, opposite end 114. The sound tube 140 may extend from the first end 112 of the housing 110. In various embodiments, an eartip 142 may be coupled to the sound tube 140 to provide a sealing fit within an ear canal of a user when the in-the-ear electronic earplug 100 is inserted into the ear canal of the user. The housing 110 may define a cavity or cut out portion 116 that is covered by an integrated windscreen 120 matching the opening of the cavity or cut out portion 116. In this way, a continuous outer profile of the in-the-ear electronic earplug 100 is accomplished such that the integrated windscreen 120 does not protrude from the in-the-ear electronic earplug 100. The cavity or cut out portion 116 covered by the windscreen 120 may be positioned at the first end 112 near the sound tube 140 such that when the sound tube 140 is inserted into an ear canal, the cavity or cut out portion 116 covered by the windscreen 120 is behind a tragus 12 of the user as shown in FIG. 4.

Still referring to FIGS. 1-4, the housing 110 includes an acoustic inlet 118 corresponding to and in close proximity to each inlet of microphone 150. The acoustic inlet(s) 118 allow ambient sound to enter the housing 110 and the microphone(s) 150 disposed within housing 110. The acoustic inlet(s) 118 are provided in the cut-out or cavity section 116 of the housing 110 that is covered by the windscreen 120. In certain embodiments, two acoustic inlets 118 corresponding with two microphones 150 are employed to reduce the net equivalent input self-noise level by 3 decibels; however, more or less microphones 150 each with a corresponding acoustic inlet 118 are envisioned. In various embodiments, the microphone(s) 150 are positioned at the first end 112 of the housing 110 between the cut-out or cavity section 116 of the housing 110 and the sound tube 140 to reduce the effects of wind noise. In this way, the microphone (s) 150 are located deep in the pinna 10 as shown in FIG. 4, and preferably as deep as possible into the canal of a user when the in-the-ear electronic earplug 100 is inserted into the canal of the user. By embedding the microphone(s) 150 at the first end 112 of the housing 110 as shown in FIGS. 2-3, for example, the microphone(s) 150 are closer to the ear canal. Depending on the direction of the wind relative to a user's head, the placement of the microphone(s) 150 at the first end 112 of the housing 110 between the cut-out or cavity section 116 of the housing 110 and the sound tube 140 such that the microphone(s) 150 are located deep in the pinna 10 may provide a wind noise reduction from 5 to 30 dB.

Various embodiments provide a protective and acoustically transparent windscreen 120 to protect the microphone(s) 150 while allowing sound to freely access the microphones(s) 150. The windscreen 120 includes a screen having an outer surface 122 and can be sintered plastic, or in a preferred embodiment, a perforated metal screen with openings 124 sufficiently small to substantially block wind ingress while allowing ambient sound to traverse the screen. In this way, the screen is substantially blocks wind yet is substantially acoustically transparent. In various embodiments, the size of the openings 124 may be selected to prevent and/or minimize water ingress. In an exemplary embodiment, the screen has a thickness of 0.2 mm, a hole size of 0.4 mm, and net open area of approximately 30% (defined as 25-35%). The internal volume between the windscreen 120 and the acoustic inlet(s) 118 is hollow (i.e., empty), with the exception of the acoustic inlet covering(s) 130 over the at least one acoustic inlet 118. The acoustic inlet covering(s) 130 may be sintered plastic or any suitable acoustically transparent but hydrophobic covering. The acoustic inlet covering(s) 130 may be small rectangular coverings, or any suitable shape. An advantage of maintaining an open internal volume in comparison to a bulk porous material is faster evaporation and elimination of any water that may ingress through the windscreen 120.

In various embodiments, a minimum distance is maintained between the acoustic inlet(s) 118 and the outer surface 122 of the screen. The distance separating the acoustic inlet(s) 118 from the wind noise appearing at the outer surface 122 of the screen is a primary determinant of an effectiveness of the windscreen 120 in reducing wind noise transferred to the microphone(s) 150 of the electronic earplug 100. For example, an overall effectiveness of the windscreen 120 relates to the minimum distance from the acoustic inlet(s) 118 to the nearest outer surface 122 of the screen. The windscreen 120 maintains a defined minimum distance from the effective center of the at least one acoustic inlet to the nearest outer surface 122 of the windscreen 120. The effective center of the at least one acoustic inlet is defined as a center of one acoustic inlet 118 or a center point between multiple acoustic inlets 118 within the cut-out or cavity portion 116 of the housing 110. The minimum distance from the effective acoustic inlet within the cut-out or cavity portion 116 of the housing 110 to the nearest outer surface 122 of the screen is greater than or equal to 2.5 mm, and preferably, greater than or equal to 3.4 mm. For example, a minimum distance from the effective acoustic inlet to the nearest outer surface 122 of the screen can be substantially 3.4 millimeters, in a range between 2.5-4.5 millimeters, and/or greater than 2.5 millimeters, among other things.

In certain embodiments, the in-the-ear electronic earplug 100 maintains an acoustically open path through the windscreen 120 to the outside over as wide an included angle as practical. In various embodiments, the acoustic paths are maintained substantially free of obstruction by acoustically opaque structures over substantially included angles greater than 100 degrees, as measured from the center point between the two acoustic inlets 118 if two microphones 150 are used or the center point of the one acoustic inlet 118 if one microphone 150 is employed. In certain embodiments, the angle is preferably from 118 degrees to 145 degrees.

The in-the-ear electronic earplug 100 is configured to receive sound behind a tragus 12 and adjacent to an ear canal at one or more microphones 150. The microphone(s) 150 converts the sound to electrical signals and provides the electrical signals to processing circuitry 160 for modifying the sound level. The processing circuitry 160 passes the electrical signals to a receiver 170. The receiver 170 converts the electrical signals to sound, which is communicated from the receiver 170 to a user's ear canal through the sound tube 140. The electronic earplug 100 can be configured to attenuate sounds above a threshold sound pressure level. In various embodiments, electronic earplugs 100 may be provided for a left ear and/or a right ear.

In order to provide substantial reduction in wind noise in an in-the-ear electronic earplug 100 (or related hearing device), various embodiments provide an integral windscreen 120 of modest dimensions combined with an electronic limiter capable of further reducing and limiting the level of wind noise transmitted on to the wearer's hearing, all with low signal distortion to minimize disruption of desired sounds such as concurrent speech.

High-Level Limiter

By creating an environment where the wind noise at the microphone(s) 150 is reduced, the amount of reduction using other mechanisms, such as the High-Level Limiter described below, can be reduced to achieve a given benefit. Additionally and/or alternatively, a more effective noise limiter may be provided with the same amount of reduction.

The in-the-ear electronic earplug 100 guards against the dangers of very loud sounds such as gunshots through an effective ear seal and controlled electroacoustic clipping, limiting the maximum sound level that can reach a user's ear drums. Beyond these momentary, impulsive sounds, two other general types of very high level sounds have been identified that can potentially create difficulties for the user of an in-the-ear electronic earplug 100 and for the technology incorporated in the earplug: 1) wind noise generated at the microphone acoustic inlet 118 from strong winds, and 2) high-level sustained sounds such as the reverberation from gunshots inside an indoor shooting range.

Figure 7:
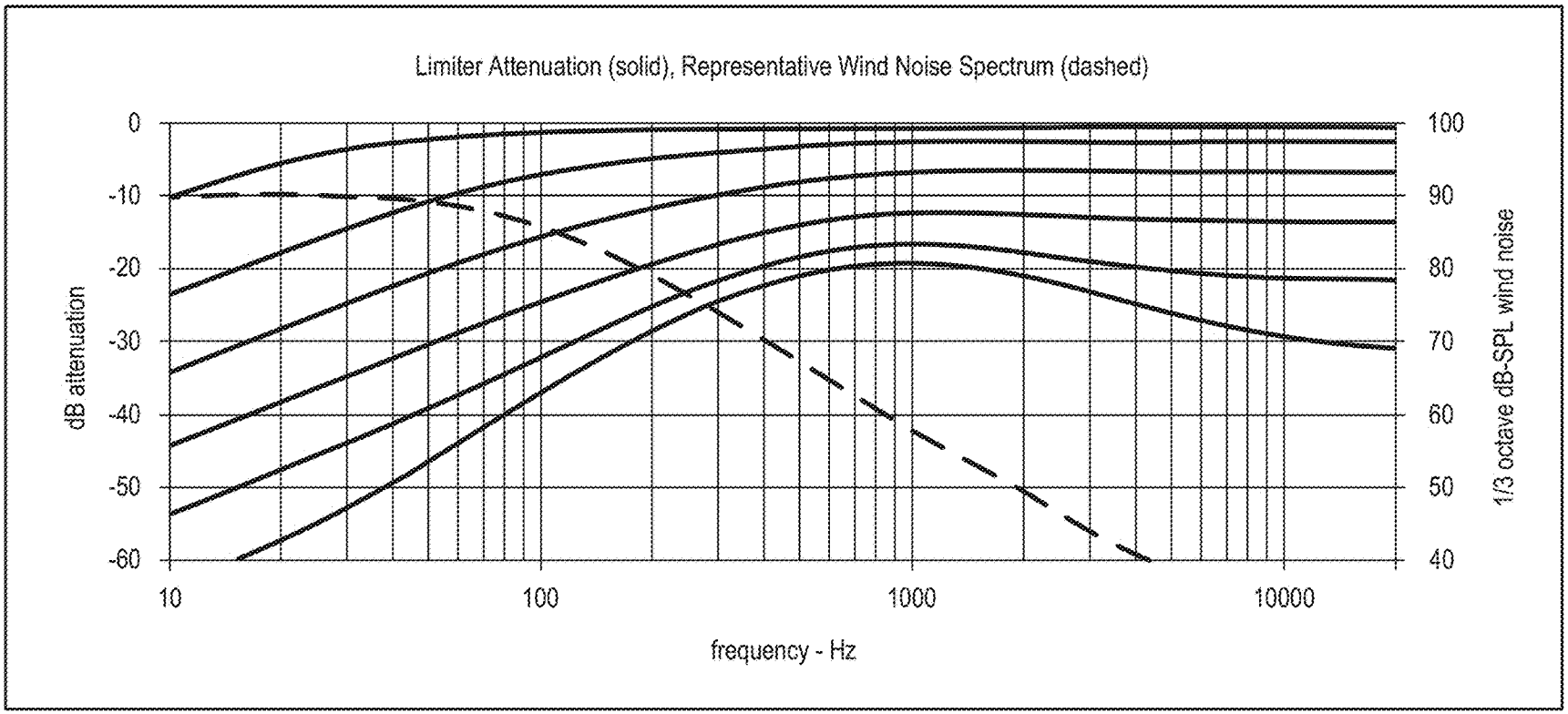
FIG. 7 is a graph of exemplary spectral attenuation characteristics of an exemplary high-level limiter with respect to an exemplary wind noise spectrum for moderate wind speeds, in accordance with various embodiments.

The first line of attack against wind noise is a physical wind filter 120. An integral wind filter 120 of an acceptable size and configuration for an in-the-ear electronic earplug 100 can provide a modest amount of reduction. FIG. 7 is a graph of exemplary spectral attenuation characteristics of an exemplary high-level limiter with respect to an exemplary wind noise spectrum for moderate wind speeds, in accordance with various embodiments. A typical wind noise spectrum for moderate wind speeds as it appears at the output of the microphone 150 behind an acceptable wind screen 120 is shown by the dashed line in the graph (scale to the right). Higher wind speeds raise this curve. The wind noise spectrum is typically heavily weighted towards the lower frequencies, including subsonic frequencies.

Figure 5:
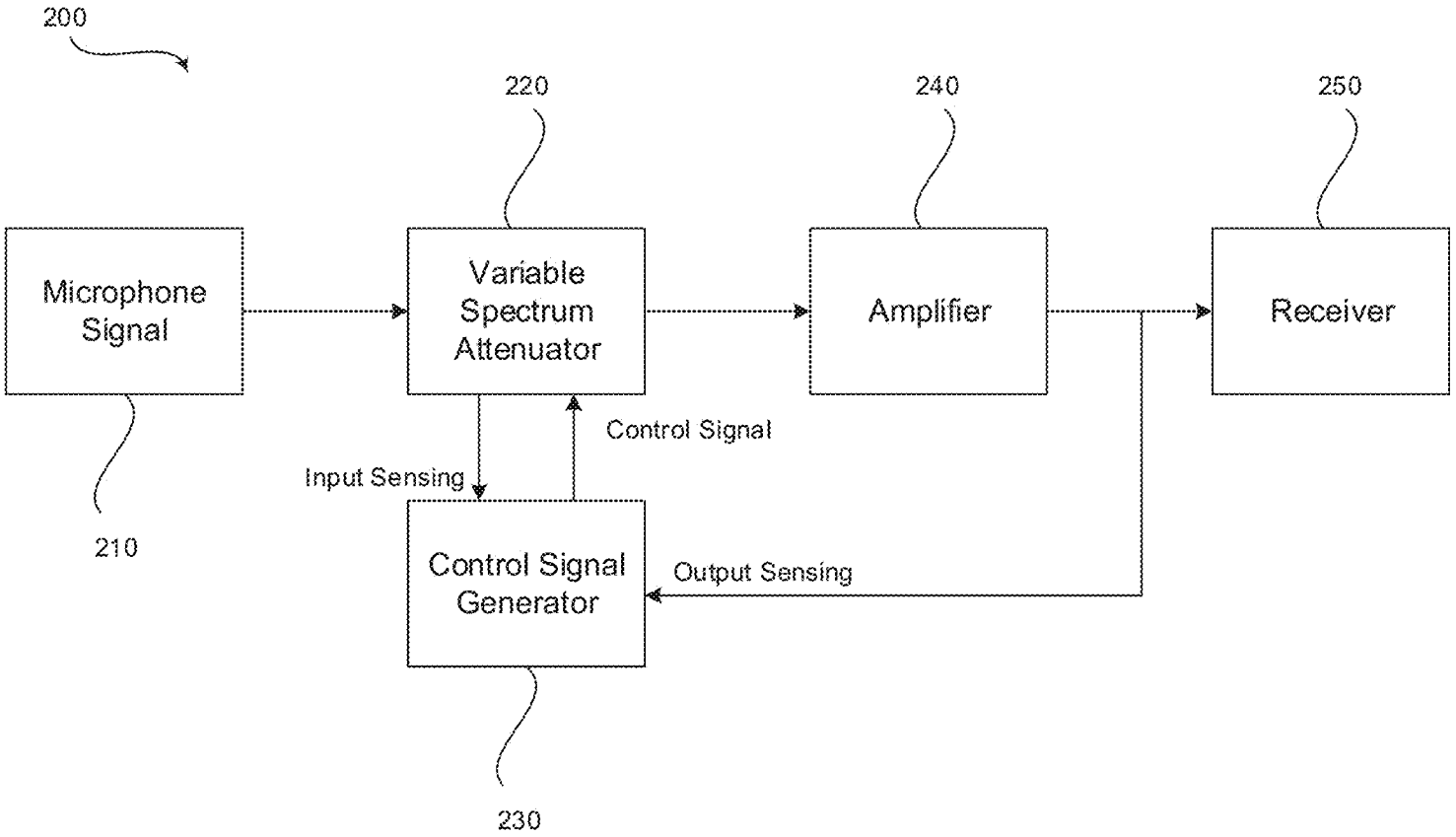
FIG. 5 is a block diagram of an exemplary high-level limiter, in accordance with various embodiments.
Figure 6:
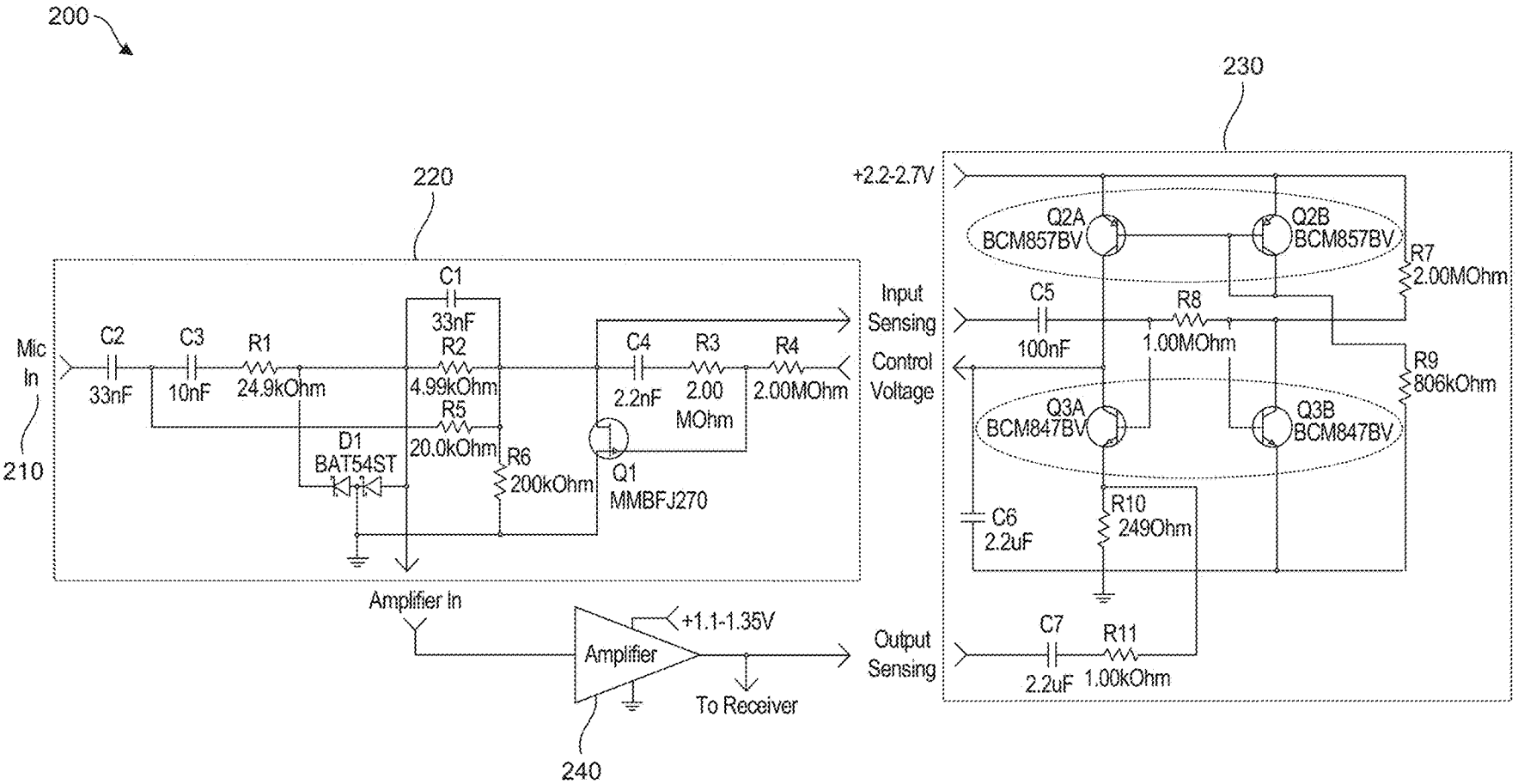
FIG. 6 is a circuit diagram of an exemplary high-level limiter, in accordance with exemplary embodiments.

Various embodiments apply variable spectrum limiting (gain reduction) for sustained sounds that would otherwise result in overload of either the input or the output of the receiver (loudspeaker) drive amplifier 240, shown in FIGS. 5-6. By preventing sustained overload (beyond brief clipping from impulsive sounds such as a gunshot), the quality and clarity of the sound is preserved, for both undesired sounds such as wind noise and simultaneous desired sounds such as speech. This is important for user comfort, for control of the overall loudness, to maintain intelligibility of the desired sounds, and to avoid user annoyance. In the case of wind noise, an impractically large windscreen may be used to achieve this result using only the windscreen.

An important aspect of the limiter 200 is its spectral attenuation characteristics, shown in the multiple representative response/attenuation curves in FIG. 7. The lower curves represent increasing attenuation (scale to the left). Recognizing that the undesired wind noise is heavily weighted towards the lower frequencies, this frequency region is attenuated first, before the critical voice range in the roughly 300 Hz to 3 kHz region, and much more than those midrange frequencies. This enables significant attenuation of wind noise energy before significant attenuation of speech energy occurs.

The limiter 200 is also effective for other very loud sounds that may not have the low frequency spectral emphasis of wind noise. The early low frequency attenuation of the limiter 200 is not as important for these other sounds, but is not a detriment and can still provide some degree of benefit over a non-frequency selective limiter, depending on the nature of the offending sound.

As mentioned above, another important sustained very loud sound is the reverberant trail of a gunshot inside an indoor gun range. The disclosed limiter 200 is effective in addressing this type of sound. An additional practical consideration that is not immediately evident is that the amplifier 240 in FIGS. 5-6 should provide a large amount of high frequency boost relative to the mid and lower frequencies in order to yield the appropriate acoustic response from the balanced armature receivers 250 used. For loud sounds with significant high frequency content such as gunshot reverberation, additional high frequency attenuation from the limiter 200 is desirable to prevent amplifier 240 high frequency output overload. As with the low frequency attenuation, this should be applied with the least additional attenuation practical of the important voice frequencies in the midband. The additional high frequency attenuation at high overall limiting levels can be seen in FIG. 7.

FIG. 5 is a block diagram of an exemplary high-level limiter 200, in accordance with various embodiments. In various embodiments, the high-level limiter 200 may correspond with a portion of the processing circuitry 160 of FIGS. 2-3. Referring to FIG. 5, the high-level limiter 200 comprises a variable spectrum attenuator 220, a control signal generator 230, and an amplifier 240. The variable spectrum attenuator 220 may comprise suitable logic, circuitry, interfaces and/or code configured to receive a microphone signal 210 and selectively attenuate a frequency below a voice range more than a frequency in the voice range as shown in FIG. 7. The voice range is defined as 300 Hz to 3 kHz. The variable spectrum attenuator 220 may include a high pass filter and low pass filter that operate when the microphone signal is high (e.g., above a threshold) based on a control signal from the control signal generator 230. The microphone signal 210 may be provided by a microphone 150 of the in-the-ear electronic earplug 100. In various embodiments, the microphone signal 210 may be amplified or buffered prior to input in the variable spectrum attenuator 220. The variable spectrum attenuator 220 provides a sensing output signal (also referred to as input sensing) to the control signal generator 230 and a signal output to the amplifier 240.

The amplifier may comprise suitable logic, circuitry, interfaces and/or code configured to amplify the signal output received from the variable spectrum attenuator 220 to generate an amplifier output (also referred to as output sensing). The amplifier output may be provided to the receiver 250, which may be balanced armature receivers or any suitable receiver. The receiver 250 may correspond with the receiver 170 of FIGS. 2-3. The receiver 250 converts the electrical signals to sound, which is communicated from the receiver 250 to a user's ear canal through the sound tube 140. The amplifier output may also be provided as the output sensing to the control signal generator 230.

The selective attenuation provided by the variable spectrum attenuator 220 may be controlled by a control signal received at the variable spectrum attenuator 220 from the control signal generator 230. The control signal generator 230 may comprise suitable logic, circuitry, interfaces and/or code for generating the control signal based on the input sensing received from the variable spectrum attenuator 220 and/or an output sensing received from the amplifier 240. For example, if the input sensing, output sensing, or a combination of the input sensing and output sensing received at the control signal generator 230 exceed a threshold, the control signal generator 230 generates a control signal corresponding with a variable amount of attenuation for the variable spectrum attenuator 220 to provide as shown in FIG. 7. The generated control signal specifying the appropriate amount of attenuation is provided to and applied by the variable spectrum attenuator 220, such as by activating the high and low pass filters of the variable spectrum attenuator 220. In various embodiments, if the input sensing, output sensing, or a combination of the input sensing and output sensing received at the control signal generator 230 does not exceed the threshold, the control signal generator 230 generates a control signal instructing the variable spectrum attenuator 220 to maintain the signal output without providing the attenuation.

FIG. 6 is a circuit diagram of an exemplary high-level limiter 200, in accordance with exemplary embodiments. In various embodiments, the high-level limiter 200 may correspond with a portion of the processing circuitry 160 of FIGS. 2-3. Referring to FIG. 6, the high-level limiter 200 comprises a variable spectrum attenuator 220, a control signal generator 230, and an amplifier 240. The variable spectrum attenuator 220 comprises diodes D1, a high pass filter C2, C3, R1, a low pass filter C1, R2, a voltage controlled resistor Q1, and feedback filter C4, R3, R4. The variable spectrum attenuator 220 is configured to provide the attenuation characteristics to the received microphone input signal before feeding the signal to the amplifier 240. The variable spectral attenuation is determined by the various resistors R1-R5 and capacitors C1-C4 in conjunction with JFET Q1, operated as a voltage controlled resistor under control of its gate voltage. The high pass filter C2, C3, R1 and low pass filter C1, R2 operate when the microphone signal is high based on the voltage controlled resistor Q1 responsive to a control signal received from the control signal generator 230. The feedback filter C4, R3, R4 provides 50% negative signal feedback to the gate of Q1 to cancel even harmonic distortion and/or otherwise minimize distortion. Dual Schottky diode D1 cleanly and softly clips large momentary transients or instantaneous peaks (such as gun shots) to prevent overload of the amplifier input for those very short duration signals that do not activate the limiting circuitry. In various embodiments, the variable spectrum attenuator 220 receives a microphone signal 210 and selectively attenuates a frequency below a voice range more than a frequency in the voice range as shown in FIG. 7. The variable spectrum attenuator 220 provides a sensing output signal (also referred to as input sensing) to the control signal generator 230 and a signal output to the amplifier 240.

The amplifier 240 may be configured to amplify the signal output received from the variable spectrum attenuator 220 to generate an amplifier output (also referred to as output sensing). The amplifier output may be provided to a receiver and to the control signal generator 230 as the output sensing.

The control signal generator 230 may be configured to generate the control signal (also referred to as control voltage) based on the input sensing received from the variable spectrum attenuator 220 and/or an output sensing received from the amplifier 240. The control signal generator 230 may comprise a control capacitor C6, a current source Q2A, Q2B, and a current sink Q3A, Q3B. The control voltage appears across control capacitor C6. The control voltage rests at almost the positive supply voltage of 2.2 to 2.7 volts and is pulled down to the JFET active region when called upon, beginning its action at the JFET threshold voltage of 0.5 to 2.0 volts and lowering further as needed to control the sensed levels.

The current source Q2A, Q2B establish a current source of 2.5 uA from the collector of Q2A. The current sink Q3A, Q3B establish a resting current sink of 0.9 uA. Thus, at rest, Q2A is held in saturation. Signals of sufficient amplitude appearing at either the input sensing or output sensing block inputs result in an increase in the average current sunk by Q3A, eventually overcoming Q2A's current source and pulling the control voltage block output down towards ground. The control voltage is pulled down until the resultant spectral attenuation reduces either the input sensing or the output sensing signal levels, whichever has the controlling signal level, to the point where additional limiting is not needed. In various embodiments, the amplifier 240 can be set for different gains. That gain setting and the spectral content of the signal may determine whether the amplifier input signal or the amplifier output signal provides the controlling sensing.

In operation, if the input sensing, output sensing, or a combination of the input sensing and output sensing received at the control signal generator 230 exceed a threshold, the control voltage of the control signal generator 230 is pulled down to a level corresponding with a variable amount of attenuation for the variable spectrum attenuator 220 to provide as shown in FIG. 7. The control voltage corresponding with the appropriate amount of attenuation is provided to and applied by the variable spectrum attenuator 220, such as by the voltage controlled resistor Q1 activating the high C2, C3, R1 and low C1, R2 pass filters of the variable spectrum attenuator 220. In various embodiments, if the input sensing, output sensing, or a combination of the input sensing and output sensing received at the control signal generator 230 does not exceed the threshold, the control signal generator 230 provides the positive supply voltage of 2.2 to 2.7 volts to the variable spectrum attenuator 220 such that the variable spectrum attenuator 220 maintains the signal output without providing attenuation.

Figure 8:
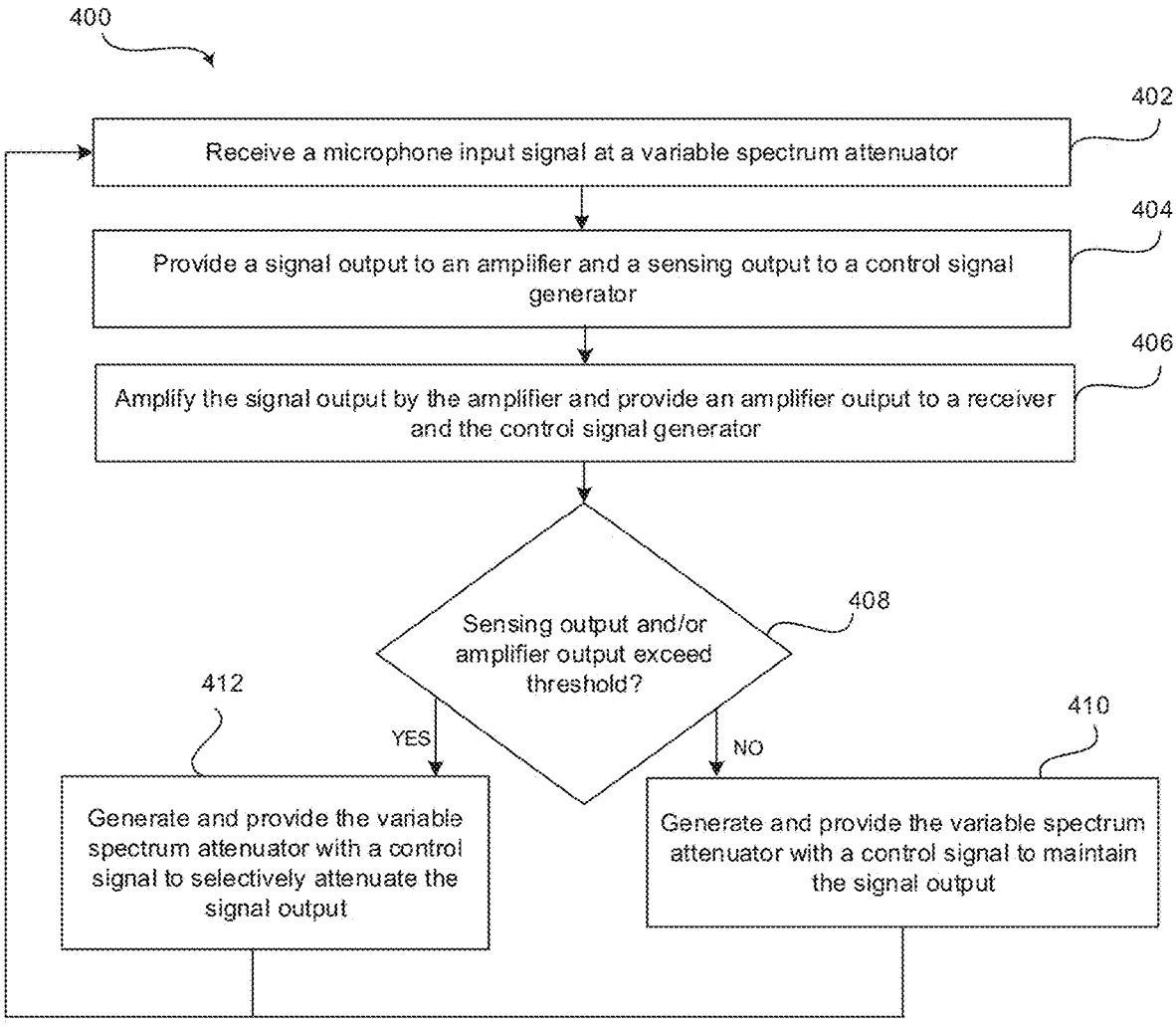
FIG. 8 is a flow chart illustrating exemplary steps that may be utilized for reducing wind noise in an in-the-ear electronic hearing protector, in accordance with exemplary embodiments.

FIG. 8 is a flow chart 400 illustrating exemplary steps 402-412 that may be utilized for reducing wind noise in an in-the-ear electronic hearing protector 100, in accordance with exemplary embodiments. Referring to FIG. 8, there is shown a flow chart 400 comprising exemplary steps 402 through 412. Certain embodiments may omit one or more of the steps, and/or perform the steps in a different order than the order listed, and/or combine certain of the steps discussed below. For example, some steps may not be performed in certain embodiments. As a further example, certain steps may be performed in a different temporal order, including simultaneously, than listed below.

At step 402, a microphone input signal 210 may be received at a variable spectrum attenuator 220. For example, the microphone input signal 210 may be provided by a microphone 150 of the in-the-ear electronic hearing protector 100. The microphone input signal 210 may be amplified, buffered, and/or otherwise processed prior to being received at the variable spectrum attenuator 220. The microphone input signal 210 may be continuously received by the variable spectrum attenuator 220 when the in-the-ear electronic hearing protector 100 is powered on.

At step 404, the variable spectrum attenuator 220 may provide a signal output to an amplifier 240 and a sensing output to a control signal generator 230. For example, the variable spectrum attenuator 220 may provide a selective amount or no attenuation to the microphone input signal 210 responsive to a control signal received by the variable spectrum attenuator 220 from a control signal generator 230. For example, if the microphone input signal 210 is high, the variable spectrum attenuator 220 may selectively attenuate frequencies below a voice range more than a frequency in the voice range. In various embodiments, the variable levels of attenuation may correspond with the graph of FIG. 7. The variable spectrum attenuator 220 may provide the attenuation with high pass filters, low pass filters, feedback filters, and/or any suitable filters. In certain embodiments implemented in circuitry, the filters may be operated by a voltage controlled resistor.

At step 406, the amplifier 240 may amplify the signal output and provide the amplifier output to a receiver 170, 250 and the control signal generator 230. For example, the amplifier output may be provided to a receiver 170, 250, which may be balanced armature receivers or any suitable receiver. The receiver 170, 250 may convert the electrical signals to sound, which may be communicated from the receiver 170, 250 to a user's ear canal through a sound tube 140. The amplifier output may also be provided as the output sensing to the control signal generator 230.

At step 408, the control signal generator 230 may determine whether the sensing output, the amplifier output, or a combination of the sensing output and the amplifier output exceed a threshold. For example, the sensing output, amplifier output, and/or a combination of the sensing output and amplifier output exceeding the threshold may indicate wind noise, gun reverberations, or other noise is present in the microphone input signal 210.

At step 410, if the control signal generator 230 determines that the threshold is not exceeded at step 408, the control signal generator 230 may generate and provide the variable spectrum attenuator 220 with a control signal to maintain the signal output. For example, in circuit embodiments of the control signal generator 230, if the input sensing, output sensing, or a combination of the input sensing and output sensing received at the control signal generator 230 does not exceed the threshold, the control signal generator 230 may provide the positive supply voltage of 2.2 to 2.7 volts to the variable spectrum attenuator 220 such that the variable spectrum attenuator 220 maintains the signal output without providing attenuation. The process returns to step 402 to continue evaluating and selectively providing the appropriate attenuation to the microphone input signal 210 after the control signal is provided to the variable spectrum attenuator 220 at step 410. In various embodiments, the control signal generator 230 may continuously provide the control signal to the variable spectrum attenuator 220.

At step 412, if the control signal generator 230 determines that the threshold is exceeded at step 408, the control signal generator 230 may generate and provide the variable spectrum attenuator 220 with a control signal to selectively attenuate the signal output. For example, in circuit embodiments of the control signal generator 230, if the input sensing, output sensing, or a combination of the input sensing and output sensing received at the control signal generator 230 exceed a threshold, the control voltage of the control signal generator 230 may be pulled down to a level corresponding with a variable amount of attenuation for the variable spectrum attenuator 220 to provide as shown in FIG. 7. The process returns to step 402 to continue evaluating and selectively providing the appropriate attenuation to the microphone input signal 210 after the control signal is provided to the variable spectrum attenuator 220 at step 412. In various embodiments, the control signal generator 230 may continuously provide the control signal to the variable spectrum attenuator 220.

Aspects of the present disclosure provide systems 100, 200 and methods 400 for reducing wind noise in an electronic hearing protector 100. In accordance with various embodiments, an in-the-ear electronic earplug 100 comprises a housing 110 and a windscreen 120. The housing 110 comprises a cut-out portion 116 having at least one acoustic inlet 118. The windscreen 120 covers the cut-out portion 116 of the housing 110 and includes an outer surface 122. An acoustic path within the cut-out portion 116 of the housing 110 from an effective center of the at least one acoustic inlet 118 to the windscreen 120 is at least 100 degrees. A minimum distance from the effective center of the at least one acoustic inlet 118 to the outer surface 122 of the windscreen 120 is at least 2.5 millimeters.

In an exemplary embodiment, the in-the-ear electronic earplug 100 comprises a sound tube 140. The housing 110 comprises a first end 112 and a second end 114 opposite the first end 112. The sound tube 140 extends from the first end 112 of the housing. The cut-out portion 116 is at the first end 112 of the housing 110. In a representative embodiment, the in-the-ear electronic earplug 100 comprises at least one microphone 150 disposed within the housing 110 at the first end 112. The at least one microphone 150 is positioned between the cut-out portion 116 and the sound tube 140. In various embodiments, the windscreen 120 matches an opening of the housing 110 formed by the cut-out portion 116 such that the windscreen 120 does not protrude from the in-the-ear electronic earplug 100.

In certain embodiments, the windscreen 120 comprises a screen having a plurality of openings 124. In an exemplary embodiment, the screen is a perforated metal screen. In a representative embodiment, the screen has a thickness of 0.2 millimeters. Each of the plurality of openings 124 in the screen is 0.4 millimeters. In various embodiments, the windscreen 120 has a net open area of approximately 30%. In certain embodiments, the in-the-ear electronic earplug 100 comprises at least one acoustic inlet covering 130 configured to cover the at least one acoustic inlet 118. An internal volume between the windscreen 120 and the at least one acoustic inlet 118 is hollow, with the exception of the at least one acoustic inlet covering 130. In an exemplary embodiment, the in-the-ear electronic earplug 100 comprises at least one acoustic inlet covering 130 configured to cover the at least one acoustic inlet 118. The at least one acoustic inlet covering 130 is sintered plastic.

Various embodiments provide an in-the-ear electronic earplug 100 comprising a variable spectrum attenuator 220, an amplifier 240, and a control signal generator 230. The variable spectrum attenuator 220 is configured to receive a microphone input signal 210 and output a signal output and a sensing output. The amplifier 240 is configured to amplify the signal output received from the variable spectrum attenuator 220 to generate an amplifier output. The control signal generator 230 is configured to receive one or both of the sensing output from the variable spectrum attenuator 220 and the amplifier output from the amplifier 240. The control signal generator 230 is configured to responsively generate an attenuator control signal that is provided to the variable spectrum attenuator 220. The attenuator control signal directs the variable spectrum attenuator 220 to selectively attenuate a frequency below a voice range more than a frequency in the voice range of the microphone input signal 210 to provide the signal output when one or both of the sensing output and the amplifier output exceeds a threshold.

In a representative embodiment, the attenuator control signal directs the variable spectrum attenuator 220 to maintain the signal output when the sensing output and the amplifier output do not exceed the threshold. In various embodiments, the control signal generator 230 is configured to receive the sensing output from the variable spectrum attenuator 220 and responsively generate the attenuator control signal based on the sensing output. In certain embodiments, the control signal generator 230 is configured to receive the amplifier output from the amplifier 240 and responsively generate the attenuator control signal based on the amplifier output.

In an exemplary embodiment, the variable spectrum attenuator 220 comprises a high pass filter and a low pass filter operable in response to the attenuator control signal when the one or both of the sensing output and the amplifier output exceeds the threshold. In a representative embodiment, the variable spectrum attenuator 220 comprises a voltage control controlled resistor Q1. The high pass filter C2, C3, R1 and the low pass filter C1, R2 are operable based on the voltage controlled resistor Q1 responsive to the attenuator control signal. In various embodiments, the variable spectrum attenuator 220 comprises a feedback filter C4, R3, R4 configured to provide negative signal feedback to the voltage controlled resistor Q1 to cancel even harmonic distortion. In certain embodiments, the variable spectrum attenuator 220 comprises at least one diode D1 configured to clamp instantaneous peaks in the microphone input signal 210. In an exemplary embodiment, the in-the-ear electronic earplug 100 comprises a receiver 250 configured to convert the amplifier output to sound.

In certain embodiments, the in-the-ear electronic earplug 100 comprises a housing 110 and a windscreen 120. The housing 110 comprises a cut-out portion 116 having at least one acoustic inlet 118. The variable spectrum attenuator 220, the control signal generator 230, and the amplifier 240 are disposed within the housing 110. The windscreen 120 covers the cut-out portion 116 of the housing 110 and includes an outer surface 122. An acoustic path within the cut-out portion 116 of the housing 110 from an effective center of the at least one acoustic inlet 118 to the windscreen 120 is at least 100 degrees. A minimum distance from the effective center of the at least one acoustic inlet 118 to the outer surface 122 of the windscreen 120 is at least 2.5 millimeters.

As utilized herein the term "circuitry" refers to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Other embodiments of the disclosure may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for reducing wind noise.

Accordingly, the present disclosure may be realized in hardware, software, or a combination of hardware and software. The present disclosure may be realized in a centralized fashion in at least one computer system, or in a distributed fashion where different elements are spread across several interconnected computer systems. Any kind of computer system or other apparatus adapted for carrying out the methods described herein is suited.

Various embodiments may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. An in-the-ear electronic earplug comprising:

a variable spectrum attenuator configured to receive a microphone input signal and output a signal output and a sensing output;

an amplifier configured to amplify the signal output received from the variable spectrum attenuator to generate an amplifier output;

a control signal generator configured to receive one or both of the sensing output from the variable spectrum attenuator and the amplifier output from the amplifier, the control signal generator responsively generating an attenuator control signal that is provided to the variable spectrum attenuator, wherein the attenuator control signal directs the variable spectrum attenuator to selectively attenuate a frequency below a voice range more than a frequency in the voice range of the microphone input signal to provide the signal output when one or both of the sensing output and the amplifier output exceeds a threshold.

2. The in-the-ear electronic earplug of claim 1, wherein the attenuator control signal directs the variable spectrum attenuator to maintain the signal output when the sensing output and the amplifier output do not exceed the threshold.

3. The in-the-ear electronic earplug of claim 1, wherein the control signal generator is configured to receive the sensing output from the variable spectrum attenuator and responsively generate the attenuator control signal based on the sensing output.

4. The in-the-ear electronic earplug of claim 1, wherein the control signal generator is configured to receive the amplifier output from the amplifier and responsively generate the attenuator control signal based on the amplifier output.

5. The in-the-ear electronic earplug of claim 1, wherein the variable spectrum attenuator comprises a high pass filter and a low pass filter operable in response to the attenuator control signal when the one or both of the sensing output and the amplifier output exceeds the threshold.

6. The in-the-ear electronic earplug of claim 5, wherein the variable spectrum attenuator comprises a voltage control controlled resistor, wherein the high pass filter and the low pass filter are operable based on the voltage controlled resistor responsive to the attenuator control signal.

7. The in-the-ear electronic earplug of claim 6, wherein the variable spectrum attenuator comprises a feedback filter configured to provide negative signal feedback to the voltage controlled resistor to cancel even harmonic distortion.

8. The in-the-ear electronic earplug of claim 1, wherein the variable spectrum attenuator comprises at least one diode configured to clamp instantaneous peaks in the microphone input signal.

9. The in-the-ear electronic earplug of claim 1, comprising a receiver configured to convert the amplifier output to sound.

10. The in-the-ear electronic earplug of claim 1, comprising:

a housing comprising a cut-out portion having at least one acoustic inlet, wherein the variable spectrum attenuator, the control signal generator, and the amplifier are disposed within the housing; and a windscreen covering the cut-out portion of the housing, the windscreen having an outer surface, wherein an acoustic path within the cut-out portion of the housing from an effective center of the at least one acoustic inlet to the windscreen is at least 100 degrees, and wherein a minimum distance from the effective center of the at least one acoustic inlet to the outer surface of the windscreen is at least 2.5 millimeters.

* * * * *